US006315119B1

(12) United States Patent
Lee

(10) Patent No.: US 6,315,119 B1
(45) Date of Patent: Nov. 13, 2001

(54) TOOL DISPLAY RACK

(76) Inventor: Jack Lee, 53, Nan-Shi-Keng, Da-Nan Village, Mei-Shan Hsiang, Jia-Yi Hsien (TW)

( * ) Notice: Subject to any disclaimer, the term of this patent is extended or adjusted under 35 U.S.C. 154(b) by 0 days.

(21) Appl. No.: 09/676,569

(22) Filed: Oct. 2, 2000

(51) Int. Cl.[7] ..... B65D 75/56

(52) U.S. Cl. ..... 206/349; 206/477; 206/480; 206/806; 211/70.6

(58) Field of Search ..... 206/349, 372, 206/373, 378, 379, 477, 478, 479, 480, 481, 482, 1.5; 248/309.1, 222.1, 222.12; 211/70.6

(56) References Cited

U.S. PATENT DOCUMENTS

D. 412,438 * 8/1999 Kopala, Jr. ..... D9/415
D. 438,462 * 3/2001 Nichol ..... D9/415
4,634,005 * 1/1987 Kulzer et al. ..... 206/349
5,906,350 * 5/1999 Kao ..... 248/688
6,076,669 * 6/2000 Ling ..... 206/349
6,164,463 * 12/2000 Lee ..... 211/70.6
6,186,323 * 2/2001 Jansson et al. ..... 206/349
6,193,200 * 2/2001 Kao ..... 248/309.1

* cited by examiner

*Primary Examiner*—Shian Luong
(74) *Attorney, Agent, or Firm*—Charles E. Baxley

(57) ABSTRACT

A tool display rack includes a board having two apertures and a U-shaped retaining member is connected to the board. The retaining member has two insertions which extend through the two apertures. A foldable member is connected to the second insertion and the foldable member is disengagably connected to the first insertion. A tool is retained between the board and the retaining member.

5 Claims, 4 Drawing Sheets

TOOL DISPLAY RACK

FIELD OF THE INVENTION

The present invention relates to a tool display rack and a retaining member having two insertions extending through a board of the display rack. The two insertions each have a hook so as to be hooked with each other.

BACKGROUND OF THE INVENTION

A conventional tool display rack is shown in FIG. 4 and generally includes a board 12 with a hanging hole 14 and two apertures 15. A U-shaped retaining member 13 is connected to the board 12 by extending two insertions 18 through the two apertures 15. Each of the wall members 17 has a groove defined therein. Two wall members 17 extend from the board 12 and are respectively located beside the two apertures 15. A tool (not shown) is retained between the retaining member 13 and the board 12. Two ridges 16 extend from the board 12 and are located between the two apertures 15. A positioning member 11 having two hooks is slidably received between the two grooves of the two insertions 18 and is pushed by the ridges 16. The two hooks of the positioning member 11 are engaged with the two insertions 18. However, it takes a lot of time to assemble the display rack because the positioning member 11 has to be carefully engaged with the grooves and because the ridges 16 apply a force to the positioning member 11, the assemblers have to push the positioning member 11 with a lot of effort.

The present invention intends to provide a tool display rack wherein the retaining member is easily connected to the board and the two insertions of the retaining member are easily hooked with each other.

SUMMARY OF THE INVENTION

In accordance with one aspect of the present invention, there is provided a tool display rack and comprising a board having two apertures. A U-shaped retaining member has a first insertion extending from one of two ends of the retaining member and a second insertion extends from the other end of the retaining member. A foldable member is pivotally connected to the second insertion and can be connected to the first insertion when a tool is retained between the board and the retaining member.

The primary object of the present invention is to provide a tool display rack that has a retaining member which has two insertions and the two insertions can be disengagably connected with each other.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
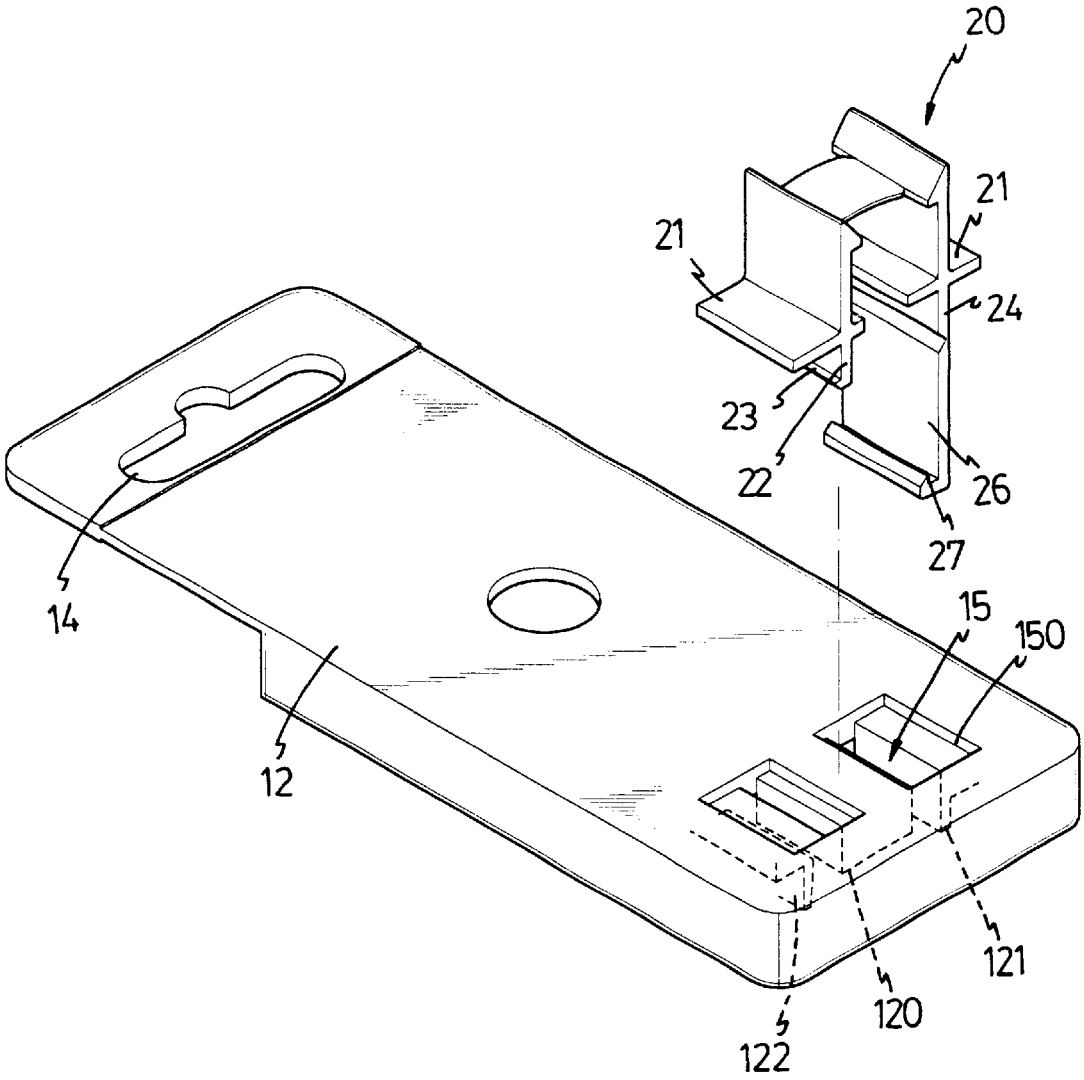
FIG. 1 is an exploded view to show a tool display rack of the present invention.
Figure 2:
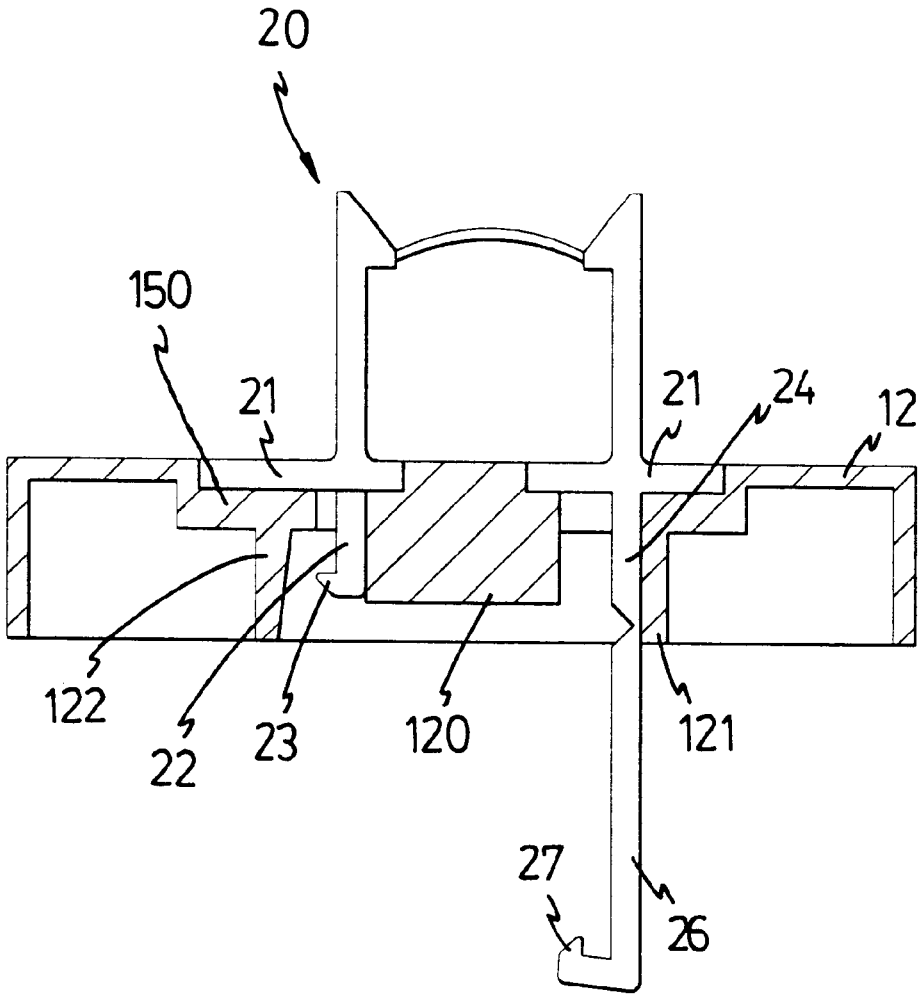
FIG. 2 is a cross sectional view to show that a retaining member is connected to a board of the tool display rack of the present invention.

Referring to FIGS. 1 and 2, the tool display rack of the present invention comprises a board 12 having a hanging slot 14 and two apertures 15 defined therethrough. Two recessed portions 150 are respectively defined in a first side of the board 12 and communicate with the two apertures 15. A protrusion 120 extends from a second side of the board 12 and is located between the two apertures 15. A first wall 121 and a second wall 122 respectively extend from the second side of the board 12, wherein the protrusion 120 is located between the first wall 121 and the second wall 122.

A foldable member 26 is connected to the second insertion 24 and has a second hook 27 which can be connected to the first hook 23 of the first insertion 22. The second insertion 24 is guided along the first wall 121 and located between the first insertion 22 and the first wall 121. Two flanges 21 respectively extend from two sides of the U-shaped retaining member 20 so as to be received in the two recessed portions 150.

Figure 3:
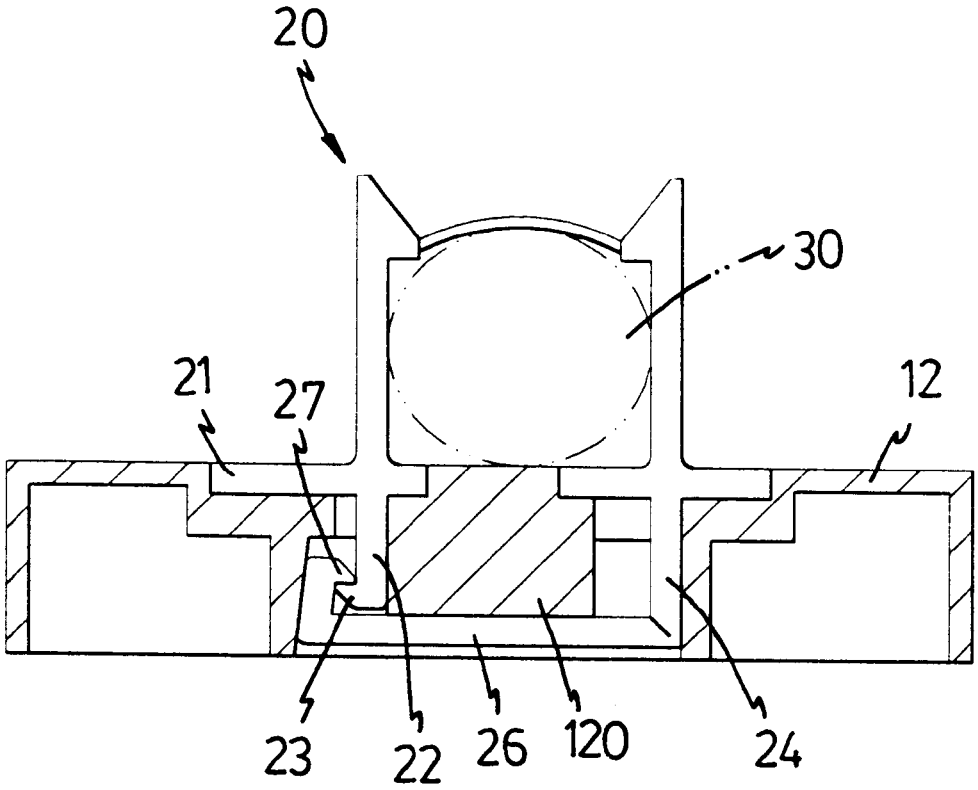
FIG. 3 is a cross sectional view to show that a foldable member connected to a second insertion of the retaining member is connected to the first insertion of the retaining member of the present invention.
Figure 4:
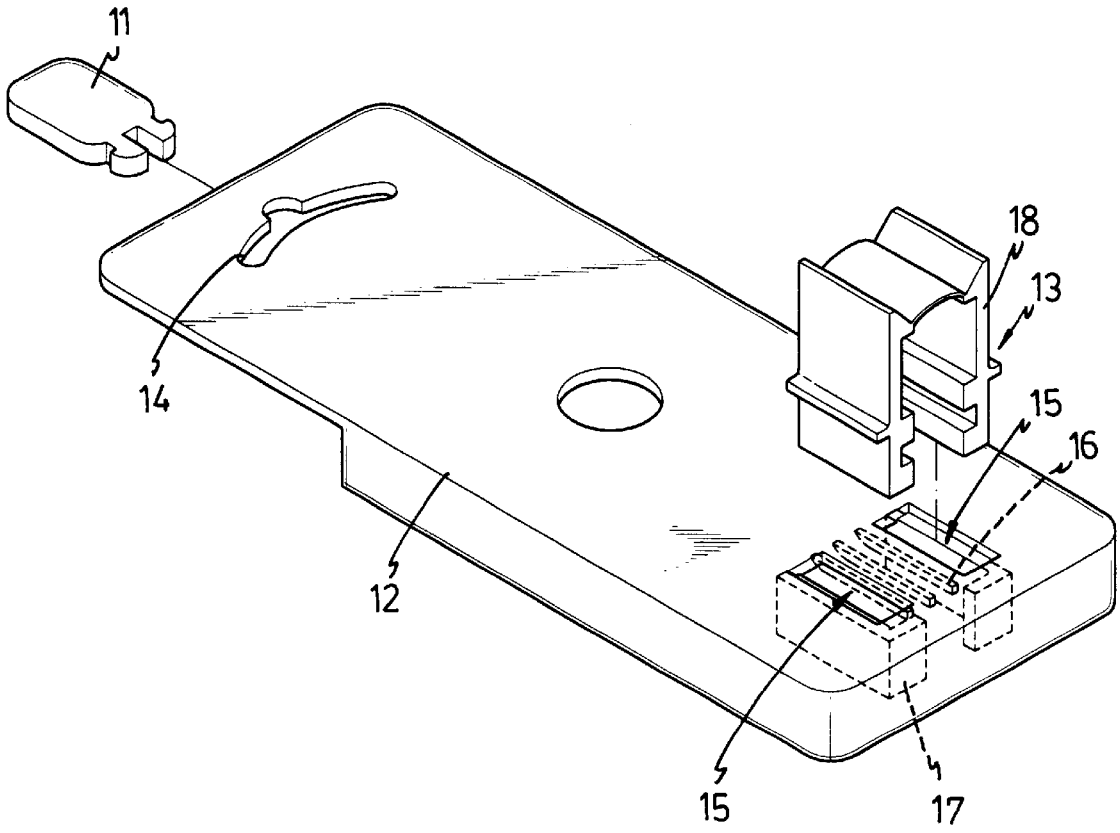
FIG. 4 PRIOR ART
FIG. 4 is an exploded view to show a conventional tool display rack.

As shown in FIG. 3, when a tool 30 is retained between the retaining member 20 and the first side of the board 12, the foldable member 26 is folded and connect the second hook 27 to the first hook 23 on the first insertion 22. Besides, the protrusion 120 contacts the foldable member 26 to enforce the connection of the first hook 27 and the second hook 27. The second hook 27 is guided by the second wall 122 and clamped between the first hook 27 and the second wall 28 when the first hook 23 is disengagably connected to the second hook 27.

Therefore, the display rack is easily to be used and the position of the connection of the first hook 23 and the second hook 27 is located between the protrusion 120 and the second wall 122 so as to avoid from being disengaged intentionally or unintentionally.

While we have shown and described various embodiments in accordance with the present invention, it should be clear to those skilled in the art that further embodiments may be made without departing from the scope and spirit of the present invention.

What is claimed is:

1. A tool display rack comprising:

a board having two apertures defined therethrough and a protrusion extending from said board, said protrusion located between said two apertures;

a U-shaped retaining member having a first insertion and a second insertion, and a foldable member connected to said second insertion and being foldable to be connected to said first insertion, said protrusion contacting said foldable member when said foldable member is connected to said first insertion.

2. The display rack as claimed in claim 1 further comprising a first wall and a second wall respectively extending from said board, said second insertion guided along said first wall and located between said first wall and said second wall, said first insertion guided along said protrusion.

3. The display rack as claimed in claim 2, wherein said first insertion has a first hook and said foldable member has a second hook which is engaged with said first hook.

4. The display rack as claimed in claim 3 wherein said second hook is guided by said second wall when said first hook is engaged with said second hook.

5. The display rack as claimed in claim 1 further comprising two recessed portions respectively defined in said board and communicating with said two apertures, two flanges respectively extending from two sides of said U-shaped retaining member, said two flanges engaged with said two recessed portions.

* * * * *